US007752014B2

(12) United States Patent
Jayanth et al.

(10) Patent No.: US 7,752,014 B2
(45) Date of Patent: Jul. 6, 2010

(54) COMPRESSOR MEMORY SYSTEM AND METHOD

(75) Inventors: Nagaraj Jayanth, Sidney, OH (US); Antonio Lopez, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/474,798

(22) Filed: Jun. 26, 2006

(65) Prior Publication Data

US 2006/0238391 A1 Oct. 26, 2006

Related U.S. Application Data

(63) Continuation of application No. 11/405,021, filed on Apr. 14, 2006.

(60) Provisional application No. 60/674,781, filed on Apr. 26, 2005.

(51) Int. Cl.
*G05B 23/02* (2006.01)

(52) U.S. Cl. ..... 702/182; 340/3.31; 340/3.32

(58) Field of Classification Search ..... 702/33–35, 702/182

See application file for complete search history.

(56) References Cited

U.S. PATENT DOCUMENTS

| | | | | |
|---|---|---|---|---|
| 4,345,162 | A | 8/1982 | Hammer et al. | 307/39 |
| 4,580,947 | A | 4/1986 | Shibata et al. | 417/8 |
| 4,655,688 | A | 4/1987 | Bohn et al. | 417/18 |
| 4,975,024 | A | 12/1990 | Heckel | 417/20 |
| 5,611,674 | A | 3/1997 | Bass et al. | 417/220 |
| 5,613,841 | A | 3/1997 | Bass et al. | 417/310 |
| 5,713,724 | A | 2/1998 | Centers et al. | 417/53 |
| 5,741,120 | A | 4/1998 | Bass et al. | 417/44.2 |
| 5,886,726 | A | 3/1999 | Pawelka et al. | |
| 5,894,596 | A | 4/1999 | Hayes, Jr. | |
| 5,930,553 | A | 7/1999 | Hirst et al. | |
| 5,975,854 | A | 11/1999 | Culp, III et al. | 417/18 |
| 6,086,335 | A | 7/2000 | Bass et al. | 417/220 |
| 6,125,312 | A | 9/2000 | Nguyen et al. | |
| 6,176,686 | B1 | 1/2001 | Wallis et al. | 417/310 |
| 6,179,214 | B1 | 1/2001 | Key et al. | 236/51 |
| 6,302,654 | B1 | 10/2001 | Millet et al. | 417/63 |

(Continued)

FOREIGN PATENT DOCUMENTS

EP 1 138 949 A3 6/2002

(Continued)

OTHER PUBLICATIONS

Annex to the European Search Report on European Patent Application No. EP 06 25 2199, dated Jan. 18, 2007.

(Continued)

*Primary Examiner*—Manuel L Barbee
(74) *Attorney, Agent, or Firm*—Harness, Dickey & Pierce, P.L.C.

(57) ABSTRACT

A method includes accessing a first non-volatile memory associated with a compressor using a processor associated with at least one of a second non-volatile memory and an operating memory. A method further includes storing compressor data from at least one of the second non-volatile memory and the operating memory in the first non-volatile memory and accessing the compressor data in the first non-volatile memory to evaluate compressor performance.

29 Claims, 6 Drawing Sheets

U.S. PATENT DOCUMENTS

| | | | | |
|---|---|---|---|---|
| 6,332,327 | B1 | 12/2001 | Street et al. | 62/127 |
| 6,366,199 | B1 | 4/2002 | Osborn et al. | |
| 6,406,265 | B1 * | 6/2002 | Hahn et al. | 417/19 |
| 6,471,486 | B1 | 10/2002 | Centers et al. | |
| 6,567,709 | B1 | 5/2003 | Malm et al. | |
| 6,625,997 | B1 * | 9/2003 | Schultz | 62/186 |
| 6,647,735 | B2 | 11/2003 | Street et al. | 62/132 |
| 6,694,204 | B1 | 2/2004 | Bair, III et al. | |
| 6,966,759 | B2 | 11/2005 | Hahn et al. | 417/19 |
| 6,973,794 | B2 | 12/2005 | Street et al. | 62/129 |
| 6,999,996 | B2 | 2/2006 | Sunderland | 709/208 |
| 7,000,422 | B2 | 2/2006 | Street et al. | 62/298 |
| 2002/0016655 | A1 | 2/2002 | Joao | |
| 2002/0018724 | A1 | 2/2002 | Millet et al. | 417/228 |
| 2002/0020175 | A1 | 2/2002 | Street et al. | 62/132 |
| 2002/0127120 | A1 | 9/2002 | Hahn et al. | 417/280 |
| 2004/0016241 | A1 | 1/2004 | Street et al. | 62/129 |
| 2004/0016244 | A1 | 1/2004 | Street et al. | 62/132 |
| 2004/0016251 | A1 | 1/2004 | Street et al. | 62/209 |
| 2004/0016253 | A1 | 1/2004 | Street et al. | 62/228.5 |
| 2004/0024495 | A1 | 2/2004 | Sunderland | 700/299 |
| 2004/0093879 | A1 | 5/2004 | Street et al. | 62/151 |
| 2005/0100449 | A1 | 5/2005 | Hahn et al. | 417/279 |
| 2005/0124203 | A1 | 6/2005 | Herrick et al. | |
| 2005/0232781 | A1 * | 10/2005 | Herbert et al. | 417/14 |
| 2005/0235663 | A1 | 10/2005 | Pham | |
| 2005/0252220 | A1 | 11/2005 | Street et al. | 62/129 |
| 2005/0262856 | A1 | 12/2005 | Street et al. | 62/129 |

FOREIGN PATENT DOCUMENTS

| | | |
|---|---|---|
| GB | 2 254 452 A | 10/1992 |
| WO | WO 97/18636 | 5/1997 |

OTHER PUBLICATIONS

Summary of the First Office Action received from the Mexican Institute of Industrial Property (IMPI) regarding Application No. PA/a/2006/004561. Summary provided by Goodrich, Riquelme y Asociados on Sep. 17, 2009.

"Vital Sign: Fertility; Help for Vasectomy Reversals that Fail," New York Times, Apr. 1999, 1 page.

Office Action for U.S. Appl. No. 11/405,021, dated Aug. 20, 2008.

Office Action for U.S. Appl. No. 11/474,821 dated May 28, 2008.

Office Action for U.S. Appl. No. 11/474,821 dated Sep. 19, 2007.

Office Action for U.S. Appl. No. 11/474,821 dated Dec. 12, 2008.

Office Action for U.S. Appl. No. 11/474,821 dated Aug. 6, 2009.

Office Action for U.S. Appl. No. 11/405,021 dated Sep. 3, 2009.

Office Action for U.S. Appl. No. 11/405,021, dated Mar. 24, 2009.

Office Action for U.S. Appl. No. 11/474,865, dated Jan. 23, 2008.

Office Action for U.S. Appl No. 11/474,865, dated Mar. 13, 2009.

Office Action for U.S. Appl. No. 11/474,865, dated Jun. 5, 2007.

Advisory Action Before the Filing of an Appeal Brief for U.S. Appl. No. 11/474,865, dated Jul. 30, 2009.

Notice of Allowance and Fees Due for U.S. Appl. No. 11/474,865, dated Sep. 8, 2009.

Office Action for U.S. Appl. No. 11/474,865, dated Sep. 15, 2008.

Ofice Action for U.S. Appl. No. 11/474,865, dated Nov. 28, 2006.

Notification of the First Office Action received from State Intelectual Property Office of P.R.C., translated by Liu, Shen & Associates, Sep. 30, 2009.

* cited by examiner

COMPRESSOR MEMORY SYSTEM AND METHOD

CROSS-REFERENCE TO RELATED APPLICATIONS

This application is a continuation of U.S. patent application Ser. No. 11/405,021 filed on Apr. 14, 2006, which claims the benefit of U.S. Provisional Application No. 60/674,781 filed on Apr. 26, 2005. The disclosures of the above applications are incorporated herein by reference.

FIELD

The present teachings relate to compressors, and more particularly, to a compressor with a memory system.

BACKGROUND

The statements in this section merely provide background information related to the present disclosure and may not constitute prior art.

Compressors are used in a variety of industrial and residential applications to circulate refrigerant within a refrigeration, heat pump, HVAC, or chiller system (generically "refrigeration systems") to provide a desired heating or cooling effect. In each application, it is desirable for the compressor to provide consistent and efficient operation to ensure that the refrigeration system functions properly. To this end, a compressor may be operated with an associated protection and control system.

The protection and control system may monitor operating signals generated by compressor or refrigeration system sensors and determine compressor or refrigeration system operating data. For example, the protection and control system may determine whether compressor or refrigeration system faults have occurred. Such data, however, may be lost when the protection and control system is turned off and/or when the protection and control system is no longer associated with the compressor.

A particular protection and control system may be compatible with a number of different compressor models and types of varying capacities. Traditionally, during installation it is necessary to load compressor specific data including, for example, numerical constants corresponding to the compressor model, type, and capacity into the protection and control system. Such compressor data is generally published by the compressor manufacturer, and used during refrigeration system design. The compressor data may be used during operation of the compressor by the protection and control system to control, protect, and/or diagnose the compressor and/or refrigeration system.

Loading the compressor data into the protection and control system is an additional step performed by the installer in the field. An error by the installer in the field while loading the compressor data may not be immediately apparent and may cause future compressor or refrigeration system operational problems. Further, if either the protection and control system, or the compressor, are replaced, the compressor data must be reloaded. In the field, such compressor data may be lost when the protection and control system and the compressor are no longer associated.

SUMMARY

A system is provided including a compressor having a first non-volatile memory connected to a module. The module has a processor and a second non-volatile memory. The first non-volatile memory is associated with the compressor. The module is selectively attached to the compressor and the processor is configured to access the first and second non-volatile memories.

In other features, the first non-volatile memory is embedded in the compressor or affixed to the compressor in a tamper-resistant housing.

In other features, the system further includes a connector block attached to the compressor to allow an electrical connection between an interior and an exterior of the compressor and the first non-volatile memory is embedded within the connector block.

In other features, the system further includes an RFID device that includes the first non-volatile memory.

In other features, the first non-volatile memory stores compressor specific data including at least one of: compressor model type data; compressor serial number data; compressor capacity data; compressor operating coefficient data comprising numerical constants associated with said compressor and used to calculate compressor operating data.

In other features, the first non-volatile memory stores compressor specific data including at least one of: compressor bill of materials data; compressor build sheet data; compressor build date data; compressor build plant data; compressor build shift data; compressor build assembly line data; compressor inspector data.

In other features, the first non-volatile memory stores compressor specific data including at least one of: compressor energy efficiency ratio data; compressor low voltage start data; compressor wattage data; maximum compressor electrical current data; compressor refrigerant flow data.

In other features, the first non-volatile memory stores compressor specific data including at least one of: compressor installation location data; compressor installation date data; compressor installer data; compressor purchase location data.

In other features, the first non-volatile memory stores compressor specific data including at least one of: compressor repair date data; compressor repair type data; compressor repaired parts data; compressor service technician data.

In other features, the first non-volatile memory stores compressor specific data including at least one of: suction pressure data; discharge pressure data; suction temperature data; discharge temperature data; electrical current data; electrical voltage data; ambient temperature data; compressor motor temperature data; compression element temperature data; compressor bearing temperature data; oil temperature data; compressor control data.

In other features, the first non-volatile memory stores refrigeration system data including at least one of: condenser temperature data; evaporator temperature data.

In other features, the first non-volatile memory stores compressor fault history data.

In other features, the system includes a communication device connected to the module to perform writing data to the first non-volatile memory and/or reading data from said first non-volatile memory.

Additionally, a compressor is provided having a non-volatile memory that stores manufacturing data related to the compressor.

In other features, the non-volatile memory is embedded in the compressor or affixed to the compressor in a tamper-resistant housing.

In other features, the compressor has a connector block attached to the compressor to allow an electrical connection between an interior and an exterior of the compressor, the non-volatile memory embedded within the connector block.

In other features, the compressor has an RFID device that includes the first non-volatile memory.

In other features, the manufacturing data includes at least one of: model type data of said compressor; serial number data of said compressor; capacity data of said compressor; operating coefficient data of said compressor comprising numerical constants associated with said compressor and used to calculate compressor operating data.

In other features, the manufacturing data includes at least one of: bill of materials data of said compressor; build sheet data of said compressor; build date data of said compressor; build plant data of said compressor; build shift data of said compressor; build assembly line data of said compressor; inspector data of said compressor.

In other features, the manufacturing data includes at least one of: energy efficiency ratio data of said compressor; low voltage start data of said compressor; wattage data of said compressor; maximum electrical current data of said compressor; refrigerant flow data of said compressor.

A method is provided for a compressor having a non-volatile memory. The method includes storing manufacturing data related to the compressor in the non-volatile memory.

In other features, the storing the manufacturing data related to the compressor in the non-volatile memory includes storing the manufacturing data in the non-volatile memory embedded in the compressor or affixed to the compressor in a tamper-resistant housing.

In other features, the storing the manufacturing data related to the compressor in the non-volatile memory includes storing the manufacturing data in the non-volatile memory embedded in a connector block attached to the compressor, the connector block allowing an electrical connection between an interior and an exterior of the compressor.

In other features, the storing the manufacturing data related to the compressor in the non-volatile memory includes storing the manufacturing data in the non-volatile memory in an RFID device.

In other features, the storing the manufacturing data includes storing at least one of: model type data of the compressor; serial number data of the compressor; capacity data of the compressor; operating coefficient data of the compressor comprising numerical constants associated with the compressor and used to calculate compressor operating data.

In other features, the storing the manufacturing data includes storing at least one of: bill of materials data of the compressor; build sheet data of the compressor; build date data of the compressor; build plant data of the compressor; build shift data of the compressor; build assembly line data of the compressor; inspector data of the compressor.

In other features, the storing the manufacturing data includes storing at least one of: energy efficiency ratio data of the compressor; low voltage start data of the compressor; wattage data of the compressor; maximum electrical current data of the compressor; refrigerant flow data of the compressor.

Additionally, a method is provided including accessing a first non-volatile memory associated with a compressor using a processor associated with at least one of a second non-volatile memory and an operating memory. The method also includes storing compressor data from the second non-volatile memory or the operating memory in the first non-volatile memory, and accessing the compressor data in the first non-volatile memory to evaluate compressor performance.

In other features, the accessing the first non-volatile memory includes accessing the first non-volatile memory embedded in the compressor or affixed to the compressor in a tamper-resistant housing.

In other features, method further includes electrically connecting an interior and an exterior of the compressor through a connector block wherein the accessing the first non-volatile memory includes accessing the first non-volatile memory embedded in the connector block.

In other features, the accessing the first non-volatile memory includes accessing the first non-volatile memory in an RFID device.

In other features, the storing the compressor data includes storing at least one of: compressor model type data; compressor serial number data; compressor capacity data; compressor operating coefficient data comprising numerical constants associated with said compressor and used to calculate compressor operating data.

In other features, the storing the compressor data includes storing compressor operating coefficient data comprising numerical constants associated with the compressor, the method further including calculating compressor operating data based on the compressor numerical constants.

In other features, the storing the compressor data includes storing at least one of: compressor bill of materials data; compressor build sheet data; compressor build date data; compressor build plant data; compressor build shift data; compressor build assembly line data; compressor inspector data.

In other features, the storing the compressor data includes storing at least one of: compressor energy efficiency ratio data; compressor low voltage start data; compressor wattage data; maximum compressor electrical current data; compressor refrigerant flow data.

In other features, the storing the compressor data includes storing at least one of: compressor installation location data; compressor installation date data; compressor installer data; compressor purchase location data.

In other features, the storing the compressor data includes storing at least one of: compressor repair date data; compressor repair type data; compressor repaired parts data; compressor service technician data.

In other features, the storing the compressor data includes storing at least one of: suction pressure data; discharge pressure data; suction temperature data; discharge temperature data; electrical current data; electrical voltage data; ambient temperature data; compressor motor temperature data; compression element temperature data; compressor bearing temperature data; oil temperature data; compressor control data.

In other features, the method further comprises storing refrigeration system data from the second non-volatile memory or the operating memory in the first non-volatile memory, wherein the storing refrigeration system data includes storing at least one of: condenser temperature data and evaporator temperature data.

In other features, the storing the compressor data includes storing compressor fault history data.

Additionally, a performance evaluation method for a compressor having a removable module including a processor and a first non-volatile memory is provided. The method includes accessing compressor data stored in a second non-volatile memory associated with the compressor and evaluating the compressor data to determine compressor performance.

In other features, the accessing the compressor data stored in the second non-volatile memory includes accessing the second non-volatile memory embedded in the compressor or affixed to the compressor in a tamper-resistant housing.

In other features, the method further includes electrically connecting an interior and an exterior of the compressor through a connector block wherein the accessing the compressor data includes accessing the second non-volatile memory embedded in the connector block.

In other features, the accessing the compressor data includes accessing the second non-volatile memory in an RFID device.

In other features, the accessing the compressor data includes accessing at least one of: compressor model type data; compressor serial number data; compressor capacity data; and compressor operating coefficient data comprising numerical constants associated with said compressor and used to calculate compressor operating data.

In other features, the accessing the compressor data includes accessing at least one of: compressor bill of materials data; compressor build sheet data; compressor build date data; compressor build plant data; compressor build shift data; compressor build assembly line data; compressor inspector data.

In other features, the accessing the compressor data includes accessing at least one of: compressor energy efficiency ratio data; compressor low voltage start data; compressor wattage data; maximum compressor electrical current data; compressor refrigerant flow data.

In other features, the accessing the compressor data includes accessing at least one of: compressor installation location data; compressor installation date data; compressor installer data; compressor purchase location data.

In other features, the accessing the compressor data includes accessing at least one of: compressor repair date data; compressor repair type data; compressor repaired parts data; compressor service technician data.

In other features, the accessing the compressor data includes accessing at least one of: suction pressure data; discharge pressure data; suction temperature data; discharge temperature data; electrical current data; electrical voltage data; ambient temperature data; compressor motor temperature data; compression element temperature data; compressor bearing temperature data; oil temperature data; compressor control data.

In other features, method further includes accessing refrigeration system data from the second non-volatile memory associated with the compressor, including accessing at least one of: condenser temperature data; evaporator temperature data.

In other features, the accessing the compressor data includes accessing compressor fault history data.

Additionally, a system is provided that includes a remote module operable to communicate with a plurality of local modules. Each local module includes a processor and a first non-volatile memory associated with the processor. The processor communicates with the first non-volatile memory and a second non-volatile memory associated with a compressor. The remote module includes a database of information copied from the second non-volatile memory.

In other features, the second non-volatile memory is embedded in the compressor or affixed to the compressor in a tamper-resistant housing.

In other features, the system further includes a connector block attached to the compressor to allow an electrical connection between an interior and an exterior of the compressor, wherein the second non-volatile memory is embedded within the connector block.

In other features, the system further includes an RFID device that includes the second non-volatile memory.

In other features, the local module is selectively attached to the compressor.

In other features, the local module is one of: a compressor protection and control system, a system controller, or a hand-held computing device.

In other features, the local module and the remote module are connected via a computer network.

In other features, the compressor has a connector block attached to the compressor to allow an electrical connection between an interior and an exterior of the compressor wherein the second non-volatile memory is embedded within the connector block.

In other features, the second non-volatile memory stores compressor specific data including at least one of: compressor model type data; compressor serial number data; compressor capacity data; compressor operating coefficient data comprising numerical constants associated with the compressor and used to calculate compressor operating data. The local module communicates the compressor specific data to the remote module for storage in the database.

In other features, the second non-volatile memory stores compressor specific data including at least one of: compressor bill of materials data; compressor build sheet data; compressor build date data; compressor build plant data; compressor build shift data; compressor build assembly line data; compressor inspector data. The local module communicates the compressor specific data to the remote module for storage in the database.

In other features, the second non-volatile memory stores compressor specific data including at least one of: compressor energy efficiency ratio data; compressor low voltage start data; compressor wattage data; maximum compressor electrical current data; and compressor refrigerant flow data. The local module communicates the compressor specific data to the remote module for storage in the database.

In other features, the second non-volatile memory stores compressor specific data including at least one of: compressor installation location data; compressor installation date data; compressor installer data; compressor purchase location data. The local module communicates the compressor specific data to the remote module for storage in the database.

In other features, the second non-volatile memory stores compressor specific data including at least one of: compressor repair date data; compressor repair type data; compressor repaired parts data; compressor service technician data. The local module communicates the compressor specific data to the remote module for storage in the database.

In other features, the second non-volatile memory stores compressor specific data including at least one of: suction pressure data; discharge pressure data; suction temperature data; discharge temperature data; electrical current data; electrical voltage data; ambient temperature data; compressor motor temperature data; compression element temperature data; compressor bearing temperature data; oil temperature data; compressor control data. The local module communicates the compressor specific data to the remote module for storage in the database.

In other features, the second non-volatile memory stores refrigeration system data including at least one of: condenser temperature data; evaporator temperature data. The local module communicates the refrigeration system data to the remote module for storage in the database.

In other features, the second non-volatile memory stores compressor fault history data. The local module communicates the compressor fault history data to the remote module for storage in the database.

Additionally, a compressor performance evaluation method is provided for a remote module in communication with a plurality of local modules. The method includes, for each local module, accessing a first non-volatile memory associated with a compressor using a processor associated with a second non-volatile memory or an operating memory, and storing compressor data from the second non-volatile memory or the operating memory in the first non-volatile memory. The method also includes, for the remote module, accessing the compressor data in each first non-volatile memory, storing the compressor data in a database, and accessing the database to evaluate compressor performance.

In other features, the accessing the compressor data in each first non-volatile memory includes accessing the compressor data with a computer network connection.

In other features, for the remote module, the accessing the compressor data includes accessing at least one of: compressor model type data; compressor serial number data; compressor capacity data; compressor operating coefficient data comprising numerical constants associated with said compressor and used to calculate compressor operating data.

In other features, for the remote module, the accessing the compressor data includes accessing at least one of: compressor bill of materials data; compressor build sheet data; compressor build date data; compressor build plant data; compressor build shift data; compressor build assembly line data; compressor inspector data.

In other features, for the remote module, the accessing the compressor data includes accessing at least one of: compressor energy efficiency ratio data; compressor low voltage start data; compressor wattage data; maximum compressor electrical current data; compressor refrigerant flow data.

In other features, for the remote module, the accessing the compressor data includes accessing at least one of: compressor installation location data; compressor installation date data; compressor installer data; compressor purchase location data.

In other features, for the remote module, the accessing the compressor data includes accessing at least one of: compressor repair date data; compressor repair type data; compressor repaired parts data; compressor service technician data.

In other features, for the remote module, the accessing the compressor data includes accessing at least one of: suction pressure data; discharge pressure data; suction temperature data; discharge temperature data; electrical current data; electrical voltage data; ambient temperature data; compressor motor temperature data; compression element temperature data; compressor bearing temperature data; oil temperature data; compressor control data.

In other features, for each local module, the method further includes storing refrigeration system data from the second non-volatile memory or the operating memory in the first non-volatile memory. For the remote module, the method further includes accessing the refrigeration system data in each first non-volatile memory and storing the refrigeration system data in the database.

In other features, for the remote module, the accessing the refrigeration system data includes accessing at least one of condenser temperature data and evaporator temperature data.

In other features, for the remote module, the accessing the compressor data includes accessing compressor fault history data.

Additionally, a method is provided including providing a warranty for a compressor having a non-volatile memory; receiving a claim under the warranty; examining data stored in the non-volatile memory; and responding to the claim based on the examining.

In other features, the examining the data stored in the non-volatile memory includes examining the non-volatile memory embedded in the compressor or affixed to the compressor in a tamper-resistant housing.

In other features, the examining the data stored in the non-volatile memory includes examining the non-volatile memory embedded in a connector block that provides an electrical connection between an interior and an exterior of the compressor.

In other features, the examining the data stored in the non-volatile memory includes examining the non-volatile memory in an RFID device.

In other features, the providing the warranty includes providing terms by which the compressor may be replaced or repaired.

In other features, the providing the warranty includes defining misuse of the compressor. The responding to the claim includes determining compressor misuse based on the data and the warranty and refusing to replace or repair the compressor when the data indicates compressor misuse.

In other features, the defining misuse includes defining an allowable operating range for the compressor and wherein the determining compressor misuse includes comparing the data with the allowable operating range.

In other features, the defining the allowable operating range includes defining at least one of: a refrigerant level range, a refrigerant pressure range, a refrigerant temperature range, an electrical current range, an electrical voltage range, an ambient temperature range, a compressor motor temperature range, a compressor bearing temperature range, and an oil temperature data range.

In other features, the providing the warranty includes defining misuse of the compressor. The responding to the claim includes determining compressor misuse based on the data and the warranty and replacing or repairing the compressor when the data does not indicate compressor misuse.

In other features, the responding to the claim includes refusing to replace or repair the compressor when the data indicates that the compressor is functioning.

In other features, the responding to the claim includes determining a cause of a compressor malfunction based on the examining and repairing the compressor based on the determining.

In other features, the examining the data includes examining at least one of: compressor model type data; compressor serial number data; compressor capacity data; compressor operating coefficient data comprising numerical constants associated with the compressor and used to calculate compressor operating data.

In other features, the examining the data includes examining at least one of: compressor bill of materials data; compressor build sheet data; compressor build date data; compressor build plant data; compressor build shift data; compressor build assembly line data; compressor inspector data.

In other features, the examining said data includes examining at least one of: compressor energy efficiency ratio data; compressor low voltage start data; compressor wattage data; maximum compressor electrical current data; compressor refrigerant flow data.

In other features, the examining the data includes examining at least one of: compressor installation location data; compressor installation date data; compressor installer data; compressor purchase location data.

In other features, the examining the data includes examining at least one of: compressor repair date data; compressor repair type data; compressor repaired parts data; compressor service technician data.

In other features, the examining the data includes examining at least one of: suction pressure data; discharge pressure data; suction temperature data; discharge temperature data; electrical current data; electrical voltage data; ambient temperature data; compressor motor temperature data; compression element temperature data; compressor bearing temperature data; oil temperature data; compressor control data.

In other features, the examining the data includes examining at least one of: condenser temperature data; evaporator temperature data.

In other features, the examining the data includes examining compressor fault history data.

Additionally, a method is provided including: warranting a compressor having a non-volatile memory; receiving a claim for repair or replacement of the compressor; accessing data stored in the non-volatile memory to determine if the compressor was misused; denying the claim for repair or replacement of the compressor when the data indicates that the compressor was misused; and replacing or repairing the compressor when the data indicates that the compressor was not misused.

In other features, the accessing the data in the non-volatile memory includes accessing the non-volatile memory embedded in the compressor or affixed to the compressor in a tamper-resistant housing.

In other features, the accessing the data in the non-volatile memory includes accessing the non-volatile memory embedded in a connector block that provides an electrical connection between an interior and an exterior of the compressor.

In other features, the accessing the data in the non-volatile memory includes accessing the non-volatile memory in an RFID device.

In other features, the warranting the compressor includes defining compressor misuse.

In other features, the defining the compressor misuse includes defining an allowable operating range for the compressor.

In other features, the defining said allowable operating range includes defining at least one of: a refrigerant level range, a refrigerant pressure range, a refrigerant temperature range, an electrical current range, an electrical voltage range, an ambient temperature range, a compressor motor temperature range, a compressor bearing temperature range, and an oil temperature data range.

In other features, the accessing the data stored in the non-volatile memory to determine if said compressor was misused includes comparing the data with the allowable operating range and determining if the compressor was misused based on the comparison.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
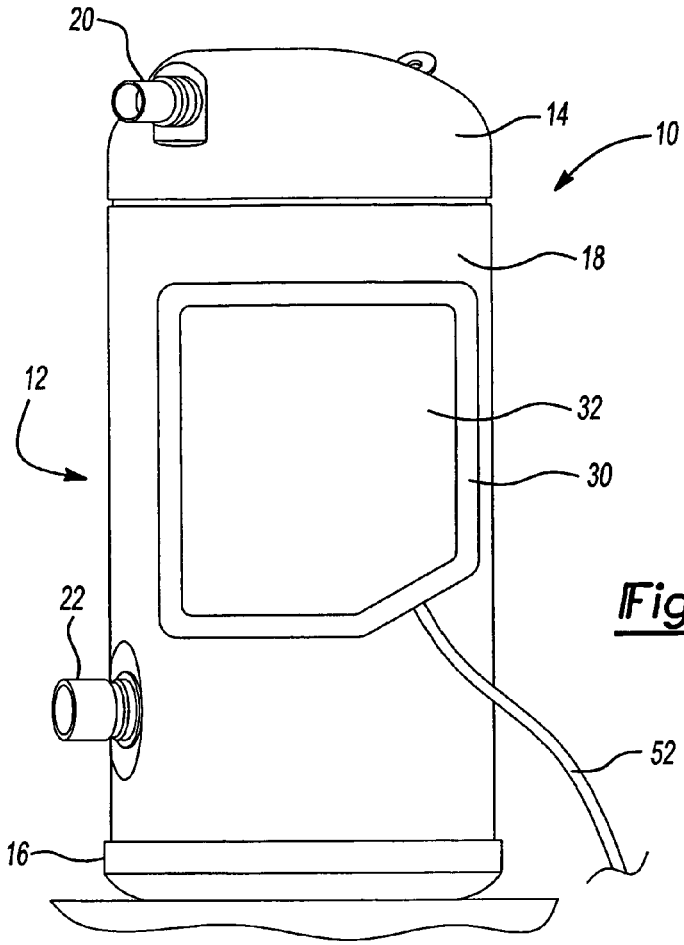
FIG. 1 is perspective view of a compressor in accordance with the present teachings.
Figure 2:
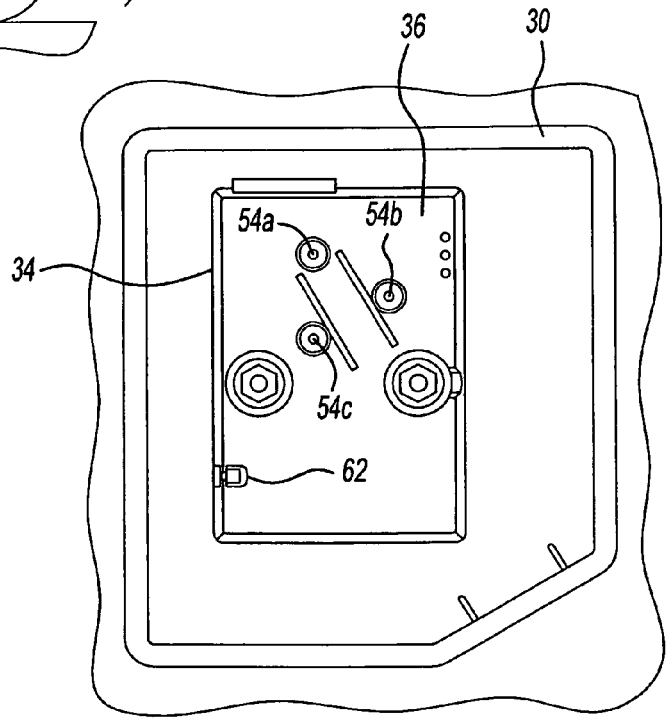
FIG. 2 is a perspective view of a protection and control system attached to a compressor in accordance with the present teachings.

The following description is merely exemplary in nature and is not intended to limit the present disclosure, application, or uses. It should be understood that throughout the drawings, corresponding reference numerals indicate like or corresponding parts and features.

As used herein, the terms module, control module, and controller refer to one or more of the following: an application specific integrated circuit (ASIC), an electronic circuit, a processor (shared, dedicated, or group) and memory that execute one or more software or firmware programs, a combinational logic circuit, or other suitable components that provide the described functionality. Further, as used herein, computer-readable medium refers to any medium capable of storing data for a computer. Computer-readable medium may include, but is not limited to, CD-ROM, floppy disk, magnetic tape, other magnetic medium capable of storing data, memory, RAM, ROM, PROM, EPROM, EEPROM, flash memory, punch cards, dip switches, or any other medium capable of storing data for a computer.

A protection and control system may monitor operating signals generated by compressor or refrigeration system sensors and determine compressor or refrigeration system operating data. The protection and control system may be of the type disclosed in assignee's commonly-owned U.S. patent application Ser. No. 11/059,646, Publication No. 2005/0235660, filed Feb. 16, 2005, the disclosure of which is incorporated herein by reference. It is understood, however, that other suitable systems may be used.

The protection and control system may be communicatively connected with a compressor and physically mounted on, but separable from, the compressor. The protection and control system may be physically separable from the compressor insofar as the protection and control system may be removed or separated from the compressor. For example, the protection and control system may be replaced or repaired and then re-mounted to the compressor.

The protection and control system may monitor compressor and/or refrigeration system operation. For example, the protection and control system may determine an operating mode for the compressor and may protect the compressor by limiting operation when conditions are unfavorable. Further, the protection and control system may determine whether compressor or refrigeration system faults have occurred.

With reference to FIGS. 1 to 4, a compressor 10 may include a generally cylindrical hermetic or semi-hermetic shell 12 with a welded or bolted cap 14 at a top portion and a welded or bolted base 16 at a bottom portion. The cap 14 and base 16 may be fitted to the shell 12 such that an interior volume 18 of the compressor 10 is defined. The cap 14 may be provided with a discharge fitting 20, while the shell 12 may similarly be provided with an inlet fitting 22, disposed generally between the cap 14 and base 16. A terminal box 30 with a terminal box cover 32 may be attached to the shell 12.

The terminal box 30 may house the protection and control system 34. The protection and control system 34 may have a protection and control system housing 36 and an integrated circuit (IC) 40 with processing circuitry 42. The protection and control system 34 may be a module and may include processing circuitry 42 that may include a data processing means such as a processor 39. The processor 39 may be a central processing unit (CPU) or a microprocessor. The processing circuitry 42 may also include random access memory (RAM) 41 and a non-volatile memory such as a read only memory (ROM) 43. Alternatively, the data processing means may be implemented by an application specific integrated circuit (ASIC), an electronic circuit, a combinational logic circuit, or other suitable components that may provide the described functionality.

The protection and control system 34 may operate according to an operating program stored in the ROM 43 to perform in the manner described herein. The RAM 41 may function as an operating memory during operation of the protection and control system 34. The processor 39 may access both the RAM 41 and the ROM 43.

The protection and control system housing 36 may include a housing face portion and a housing back portion. The protection and control system 34 may be matingly received by a hermetic connector block 44, which may be located within the terminal box 30 and fixedly attached to the compressor shell 12. The hermetic connector block 44 may maintain the sealed nature of the compressor 10 while allowing power to be delivered to the compressor motor (not pictured) via power leads 47 as discussed in more detail below. The protection and control system 34 may be mounted to the shell 12 using two studs 49 which may be welded or otherwise fixedly attached to the shell 12.

An embedded memory system 45 may include non-volatile memory 46 embedded within the compressor 10. Specifically, the non-volatile memory 46 may be embedded within the hermetic connector block 44. The memory system 45 may include a memory connector 48 interfaced with the non-volatile memory 46. The non-volatile memory 46 may contain compressor specific data including, for example, numerical constants corresponding to the compressor model, type, and capacity. In other words, certain compressor pedigree or identification information may be stored in the non-volatile memory 46.

The non-volatile memory 46 may remain within the hermetic connector block 44, attached to or embedded within the compressor 10, for the entire operating life of the compressor 10. In this way, the compressor specific data may remain with the compressor 10, stored in the non-volatile memory 46, regardless of whether the compressor is moved to a different location, returned to the manufacturer for repair, or used with different protection and control systems.

Alternatively, the non-volatile memory 46 may be located in a tamper resistant housing elsewhere on or in the compressor 10. For example, the non-volatile memory 46 may be in a tamper resistant housing embedded within, or attached to, the terminal box 30 or terminal box cover 32. In addition, the non-volatile memory 46 may be embedded within the compressor shell 12, or located within the interior volume 18 of the compressor 10. The non-volatile memory 46 may be located at any suitable location that is generally inaccessible to a user, customer, repair person, or technician. The tamper resistant housing may include a sealed package affixed, adhered, or otherwise attached to the compressor 10 and configured to house the non-volatile memory in an inaccessible and protected fashion. Additionally, the non-volatile memory 46 may be located within the protection and control system 34 on the processing circuitry 42.

The non-volatile memory 46 may be in-molded in a compressor component, such as the hermetic connector block 44, the terminal box 30, terminal box cover 32, or other suitable component for maintaining the non-volatile memory 46 in an isolated and tamper resistant manner. In this way, the non-volatile memory 46 may remain with the compressor 10 for the operating life of the compressor 10.

Figure 3:
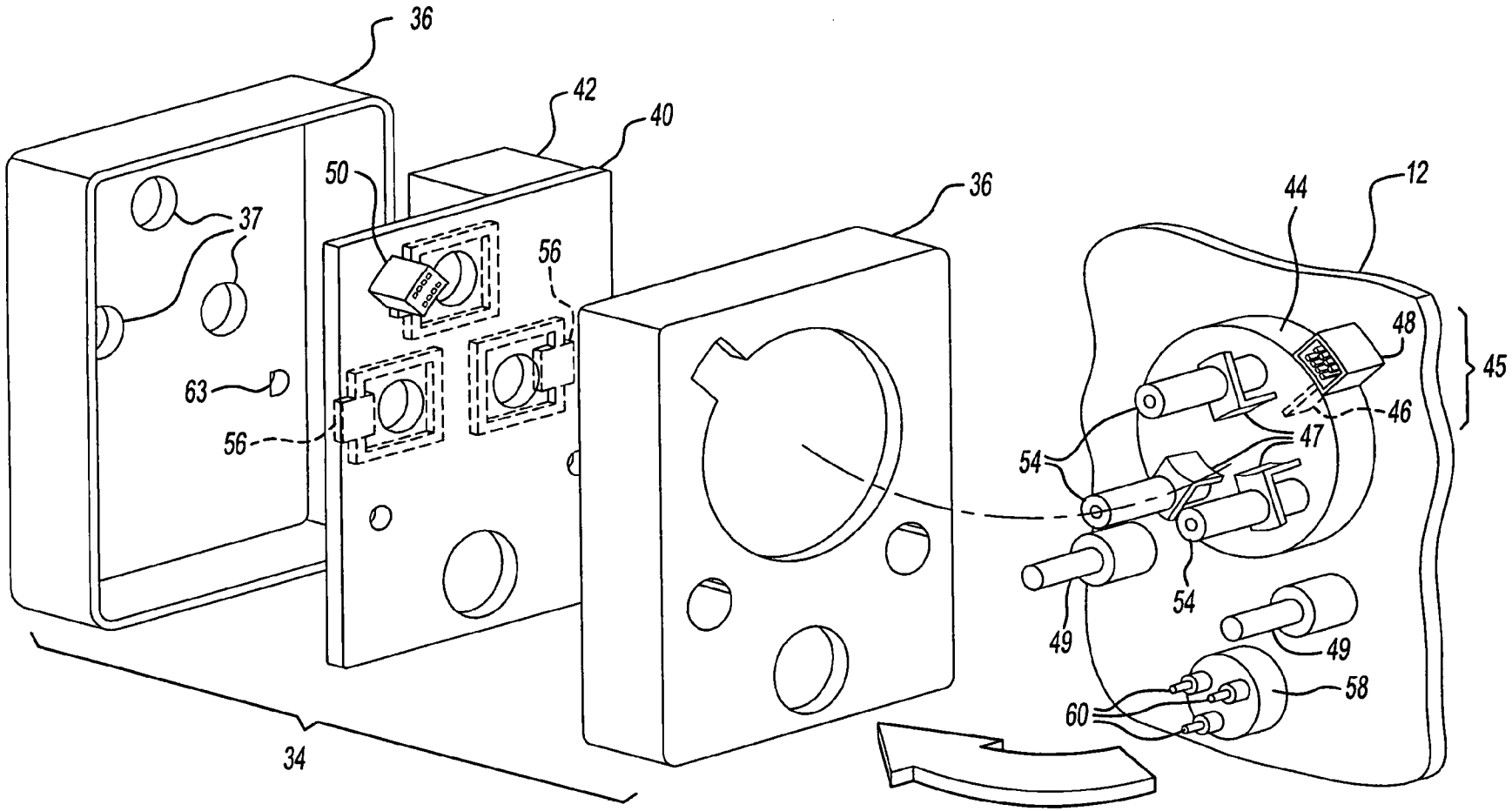
FIG. 3 is an exploded view of a protection and control system and compressor memory system in accordance with the present teachings.
Figure 4:
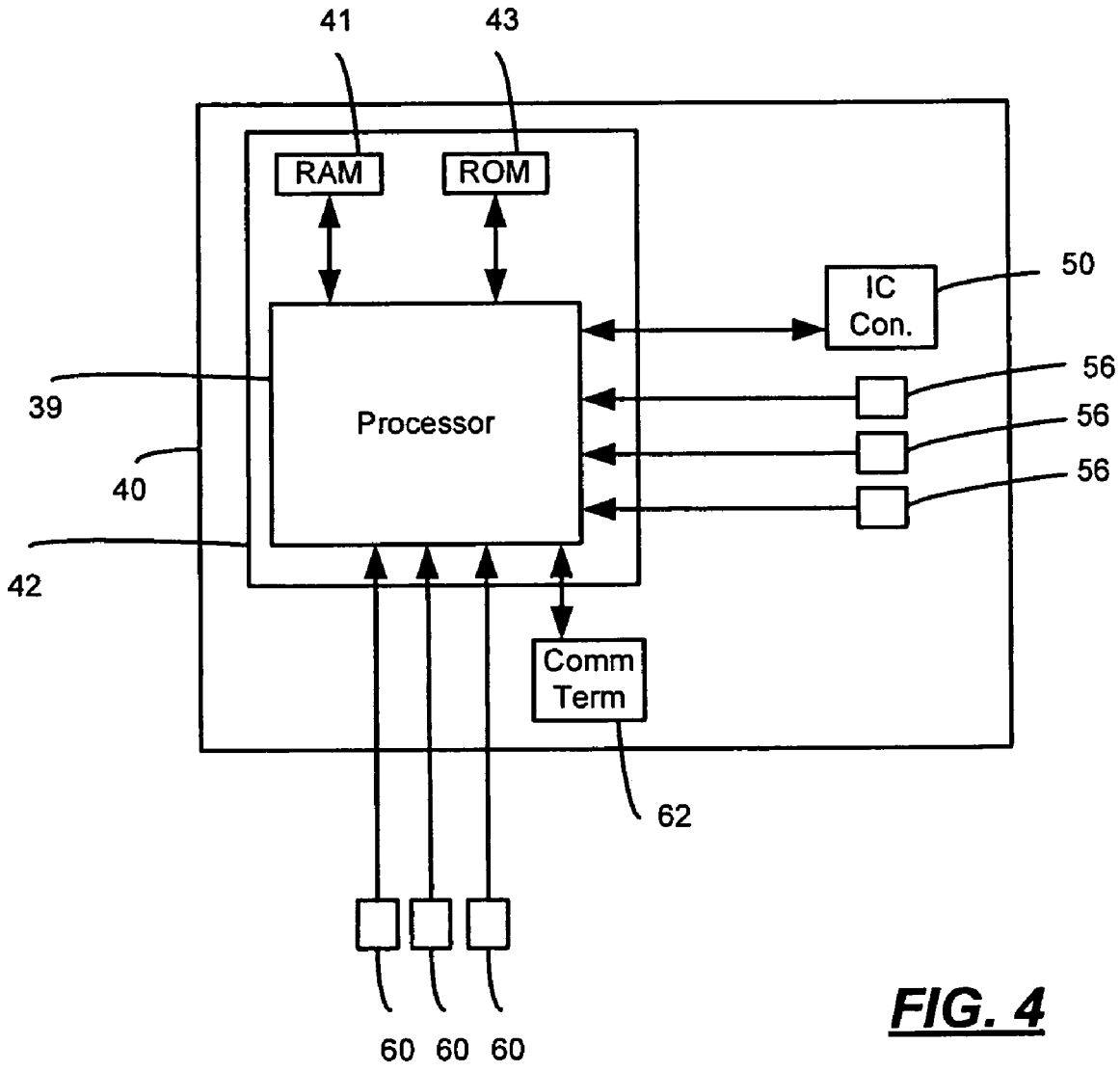
FIG. 4 is a schematic view of processing circuitry of a protection and control system in accordance with the present teachings.

The hermetic connector block 44 may be configured with a memory connector 48 in communication with the non-volatile memory 46. In this way, the non-volatile memory 46 may be read from, or written to, via the memory connector 48. As shown in FIG. 3, the memory connector 48 may include an eight pin connector. However, other connector configurations, with more or less pins, may be utilized. Further, other types of connectors may be utilized to provide an interface with the non-volatile memory 46. For example, a serial data connection may be made with the non-volatile memory 46. Additionally, a wireless device, such as an RFID device, may be used to communicate with the non-volatile memory 46.

As an example, the non-volatile memory 46 may be a two kilobyte or four kilobyte erasable programmable read-only memory (EPROM) chip or an electrically erasable programmable read only memory (EEPROM) chip. Other types and other sizes of memory devices may be utilized including flash memory, magnetic media, optical media, or other non-volatile memory suitable for storing data. Additionally, an RFID device may be used. The RFID device may include non-volatile memory and may wirelessly communicate data. If an RFID device is used, the memory connector 48 may be a wireless data communication device that allows communication with the RFID device.

As used herein, non-volatile memory is intended to refer to a memory in which the data content is retained when power is no longer supplied to it, such as an EPROM or EEPROM. Additionally, non-volatile memory may include a traditionally volatile memory configured with an independent source of power to retain data. For example, a random access memory (RAM) may be used and embedded within the compressor 10 with an independent power source, such as a battery with an expected battery life that is greater than the expected operating life of the compressor 10.

The IC 40 may be configured with an IC connector 50 such that the IC connector 50 may be matingly received by the memory connector 48 when the protection and control system 34 is attached to the hermetic connector block 44. In this way, the non-volatile memory 46 may communicate with the processing circuitry 42, via the IC connector 50 and memory connector 48. The processing circuitry 42 may read from or write to the non-volatile memory 46.

The non-volatile memory 46 may receive electrical power from the memory connector 48 and the protection and control system 34, or other device, connected to the memory connector 48. In this way, the non-volatile memory 46 may not require an independent source of electrical power.

The hermetic connector block 44 may be configured with three power leads 47 electrically connected to internal compressor components, such as a compressor motor (not pictured). Three phase electrical power may be delivered to the compressor 10 via a power cord 52 received by the terminal box 30. The power cord 52 may attach to the ends of three conductive studs 54 via apertures 37 on the face of the housing 36. The hermetic connector block 44 may receive the three conductive studs 54. Each of the three conductive studs 54 may be connected to a separate phase of the three phase electrical power delivered by the power cord 52. At installation, the power leads 47 may be bent over, such that an aperture in each of the power leads may receive one of the three conductive studs 54. In this way, the power leads 47 may be electrically connected to the conductive studs 54 and three phase electrical power may be delivered from the power cord 52 to the compressor 10.

While delivery of three phase power to the compressor 10 is described, the compressor 10 may alternatively receive single phase power. Further, any other system for delivery of power to the compressor 10 may be used.

Electrical power may also be delivered to the IC 40 and processing circuitry 42 via at least one of the conductive studs 54. While the compressor 10 may be powered by three phase electrical power, the IC 40 and processing circuitry 42 may be powered by single phase electrical power from one of the conductive studs 54.

The processing circuitry 42 may receive various operating signals generated by compressor or refrigeration system sensors. The processing circuitry 42 may determine or derive compressor or refrigeration system operating data. Electrical current sensors 56 may be located on the IC 40 and may generate electrical current signals corresponding to the amount of electrical current drawn by the compressor 10. The processing circuitry 42 may monitor the electrical current signals generated by the electrical current sensors 56. Generally, the level of current drawn by the compressor corresponds to the present load on the compressor. The current drawn by the compressor 10 generally increases as the present load on the compressor 10 increases.

Additional compressor sensors may be located within the compressor shell 12. Such internal compressor sensors may include a motor temperature sensor, a discharge line temperature sensor, a suction pressure sensor, or the like. Another hermetic connector block 58 may be fixedly attached to the compressor shell 12 and configured with conductive terminals 60 connected to each of the internal compressor sensors. The processing circuitry 42 may receive the operating signals generated by the internal compressor sensors. The processing circuitry 42 may also receive additional operating signals from additional system or compressor sensors external to the compressor 10. Based on the various operating signals, the processing circuitry 42 may determine an operating mode for the compressor 10, and may generate compressor or system fault alerts.

The protection and control system 34 may be configured with a communication terminal 62 connected to the processing circuitry 42 via an aperture 63 in the face of the housing 36. The communication terminal 62 may be connected to a number of network/communication devices. As described in more detail below and in assignee's commonly-owned U.S. patent application Ser. No. 11/059,646, Pub. No. 2005/0235660, filed Feb. 16, 2005, the communication terminal 62 may be operable to connect to, and communicate with, a handheld computing device, a system controller, or other suitable communication/network device.

Figure 5:
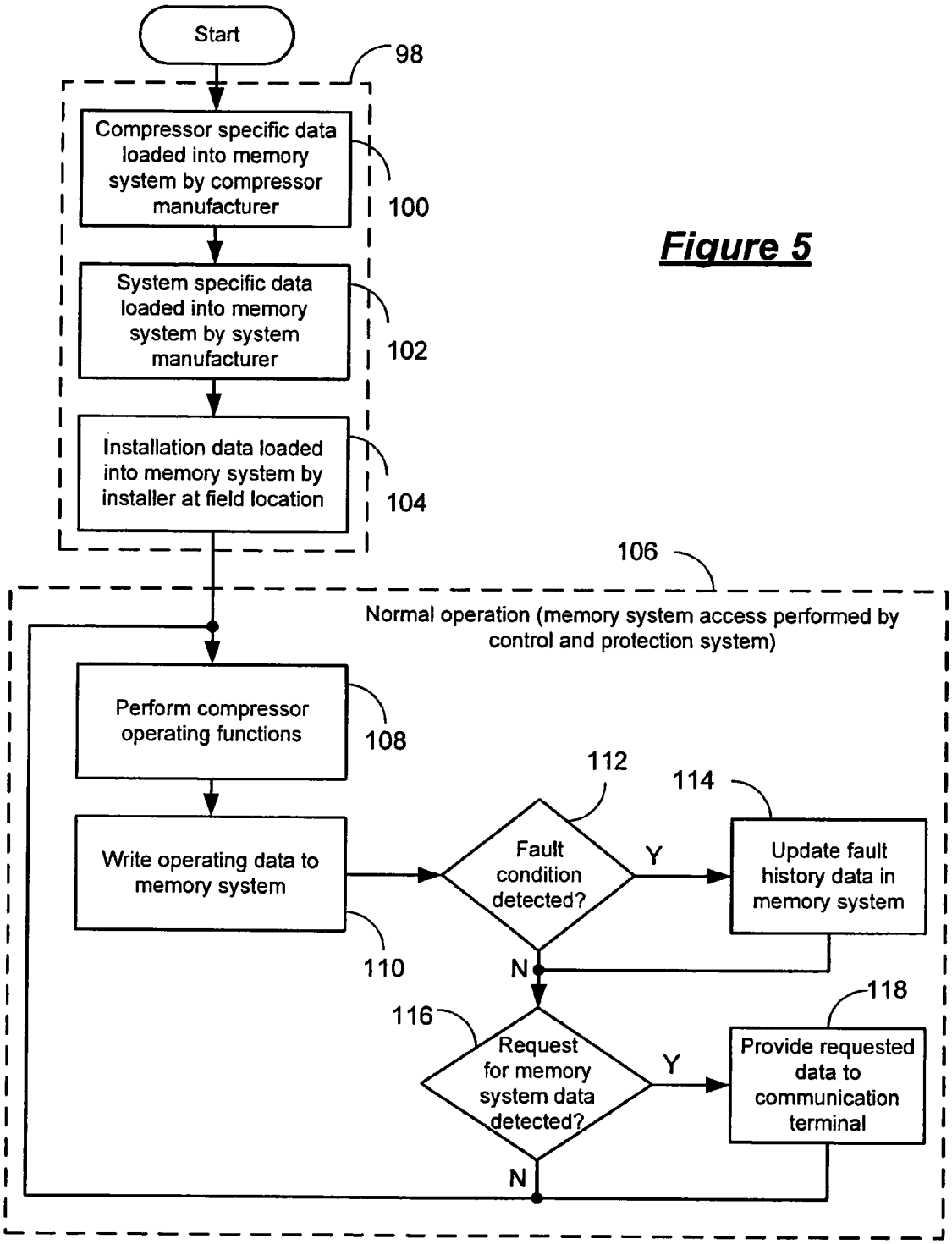
FIG. 5 is a flow chart illustrating a data access control algorithm for a compressor memory system in accordance with the present teachings.

Referring now to FIG. 5, a flow chart illustrating a data access control algorithm for a memory system 45 is shown. Prior to normal operation, the memory system 45 may be loaded with initialization data, including compressor specific data, in grouped steps 98. When the compressor 10 is initially assembled and configured with the memory system 45, the compressor manufacturer, for example, may load the memory system 45 with compressor specific data in step 100. The compressor specific data may include manufacturing data related to the specific compressor 10 with which the memory system 45 is associated.

For example, the initialization data may include the compressor model, serial number, and capacity size. A bill of materials, i.e., the list of part numbers of all the individual components of the compressor, may also be loaded into the memory system 45. The build sheet, or sequence of operations carried out in the assembly of the compressor 10, may also be loaded. Data as to the date, shift, plant, assembly line, and inspector that built and inspected the compressor 10 may also be loaded.

Compressor specific data may also include test data information loaded into the memory system 45 by the compressor manufacturer. Test data may include an energy efficiency ratio, which relates the compressor's BTU's/Hr to input power in watts. Test data may also include a low voltage start number, which represents the lowest line voltage at which the compressor 10 may start. Test data may also include a Watts number, related to the electrical power that may be input to the compressor 10. Test data may also include a maximum current drawn by the compressor 10 at maximum load. Test data may also include the amount of refrigerant flow under given test conditions.

Compressor specific data may also include compressor operating coefficient data. Each compressor 10 is associated with certain compressor-specific numerical constants to be utilized by the protection and control system 34 when making certain calculations and operating data determinations. For example, as disclosed in assignee's commonly-owned U.S. patent application Ser. No. 11/059,646, Pub. No. 2005/0235660, filed Feb. 16, 2005, the protection and control system 34 may utilize compressor-specific numerical constants to calculate data about other refrigeration system components.

For example, the protection and control system 34 may determine a condenser temperature or an evaporator temperature based on the following formula:

$$P = C_0 + (C_1 \times T_{COND}) + (C_2 \times T_{EVAP}) + (C_3 \times T_{COND}^2) + (C_4 \times T_{COND} \times T_{EVAP}) + (C_5 \times T_{EVAP}^2) + (C_6 \times T_{COND}^3) + (C_7 \times T_{EVAP} \times T_{COND}^2) + (C_8 \times T_{COND} \times T_{EVAP}^2) + (C_9 \times T_{EVAP}^3), \quad (1)$$

where P is compressor power, $T_{COND}$ is condenser temperature, $T_{EVAP}$ is evaporator temperature, and $C_0$ to $C_9$ are constants that are specific to the particular compressor model and capacity size.

Likewise, the protection and control system may determine compressor capacity according to the following equation:

$$X = Y_0 + (Y_1 \times T_{COND}) + (Y_2 \times T_{EVAP}) + (Y_3 \times T_{COND}^2) + (Y_4 \times T_{COND} \times T_{EVAP}) + (Y_5 \times T_{EVAP}^2) + (Y_6 \times T_{COND}^3) + (Y_7 \times T_{EVAP} \times T_{COND}^2) + (Y_8 \times T_{COND} \times T_{EVAP}^2) + (Y_9 \times T_{EVAP}^3) \quad (2)$$

where X is compressor capacity, $T_{COND}$ is condenser temperature, $T_{EVAP}$ is evaporator temperature, and $Y_0$ to $Y_9$ are constants that are specific to the particular compressor model and size.

Numerical constants $C_0$ to $C_9$ and $Y_0$ to $Y_9$, which are traditionally published by the compressor manufacturer and loaded into the protection and control system 34 at the time the compressor is installed in the field, may be preloaded into the nonvolatile memory 46 of the memory system 45 by the compressor manufacturer at the time the compressor 10 is built. In this way, compressor specific data is loaded into the memory system 45, thereby decreasing the installation burden on the installer in the field and minimizing the chance for installation error.

Information related to the specific refrigeration system connected to a compressor may be loaded into the memory system 45 by a system manufacturer in step 102. For example, the refrigeration system manufacturer may receive a compressor 10 configured with a memory system 45 that has been loaded by the compressor manufacturer with compressor specific information. The refrigeration system manufacturer may then use the compressor 10 as a component in a refrigeration system, with, for example, an evaporator or a condenser. The refrigeration system manufacturer may load refrigeration system information, such as component model and serial number information for the system components, such as the evaporator and the condenser, into the memory system 45.

Installation data may be loaded into the memory system 45 by the installer at the time the compressor is installed at the field location in step 104. As discussed above, the memory system 45 is configured with a memory connector 48. In the field, the memory system 45 may be accessed by the installer with a handheld device connected directly to the memory connector 48. Alternatively, the memory system 45 may be accessed after the protection and control system 34 is installed. In such case, the installer may access the memory system 45 with a handheld device connected to the communication terminal 62 of the protection and control system 34. In this way, the memory system 45 is accessible by the handheld device, via the communication terminal 62, processing circuitry 42, IC connector 50, and memory connector 48. Similarly, the memory system 45 may be accessed by other devices connected to the communication terminal 62 of the protection and control system 34.

Installation data loaded into the memory system 45 may include the installation location, the installation date, the installer's name, and the dealer from whom the compressor 10 was purchased. Additionally, subsequent to installation, if the compressor 10 is ever serviced, service information, such as a service description and a listing of replacement parts, may be loaded into the memory system 45 at that time in the same manner.

With continuing reference to FIG. 5, once the compressor 10 has been installed at the field location, the compressor 10 may enter normal operation in grouped steps 106. A normal operating cycle is generally shown in grouped steps 106. During normal operation 106, the compressor 10 may perform operating functions at step 108. During normal operation, the protection and control system 34 may monitor operating signals generated by compressor or refrigeration system sensors and may generate compressor or refrigeration system operating data. The protection and control system 34 may determine an operating mode for the compressor 10 and may determine whether compressor or refrigeration system faults have occurred.

During normal operation, the protection and control system 34 may write operating data to the memory system 45 in step 110. In a memory system 45 that utilizes a two kilobyte or four kilobyte EEPROM, operating data for the most recent two to three minutes of operation may be stored in the memory system 45. Longer periods of operating data may be stored if a memory system 45 with a greater amount of memory is utilized. When the memory allocated for storing operating data is full, the protection and control system 34 may write over the oldest operating data first. Additionally, the protection and control system 34 may partition the memory allocated for storing operating data into discrete segments. When the allocated memory is full, the oldest segment may be erased and rewritten with more recent operating data.

Operating data written to the memory system 45 may include any number of predetermined signals and parameters monitored or generated by the compressor, the refrigeration system, or the protection and control system 34. For example, operating data may include data related to electrical current drawn, compressor voltage, ambient temperature, discharge line temperature, intake line temperature, compressor motor winding temperature, compression element temperature, bearings temperature, oil temperature, discharge line pressure, intake line pressure, and the like. Operating data may also include refrigeration system data such as condenser temperature and evaporator temperature. Operating data may also include refrigeration system communication inputs, such as a refrigeration system call for cooling or heating, a defrost command, or the like.

Fault history data may also be stored in the memory system 45. The protection and control system 34 may determine whether a compressor 10 or system fault has occurred in step 112. When a fault has occurred, the protection and control system 34 may update the fault history data in the memory system 45 in step 114. Fault history data may include information related to the date, time, and type, of the most recent faults. For example, a seven day fault history may be stored in the memory system 45. Information related to the last fault, such as the last fault compressor motor temperature, last fault voltage or current, last fault oil level, last fault number of cycles, etc. may be stored in the memory system 45.

In step 116, the protection and control system 34 may determine whether a request for memory system data has been made by a device connected to the communication terminal 62. When a device requests data from the memory system 45, via the communication terminal 62, the protection and control system 34 may retrieve the requested data from the memory system 45 and provide it to the requesting device via the communication terminal 62 in step 118. The protection and control system 34 then loops back to step 108.

In this way, compressor specific data, system data, installation data, and operating data may be stored in the memory system 45 and accessed by the protection and control system 34, as well as any other devices connected to the protection and control system 34 via the communication terminal 62.

The data stored in the memory system 45 may be used to evaluate compressor performance or refrigeration system performance. For example, by examining the data stored in the memory system 45, operating data may be evaluated in light of the compressor model and capacity size, as well as in light of the installation location of the compressor. The data stored in the memory system 45 may provide insight into the operation of the compressor based on the various factors that may affect performance and based on the specific compressor specifications. In this way, the data stored in the memory system 45 may provide evaluation assistance when a new compressor is being considered for purchase or when a new compressor is being designed.

The protection and control system 34 may be connected to a network via the communication terminal 62. In such case, the memory system 45 may be accessible to other devices connected to the network. The compressor specific data, system data, and operating data may then be used to diagnose the compressor, diagnose the refrigeration system, schedule maintenance, and evaluate compressor warranty claims.

Figure 6:
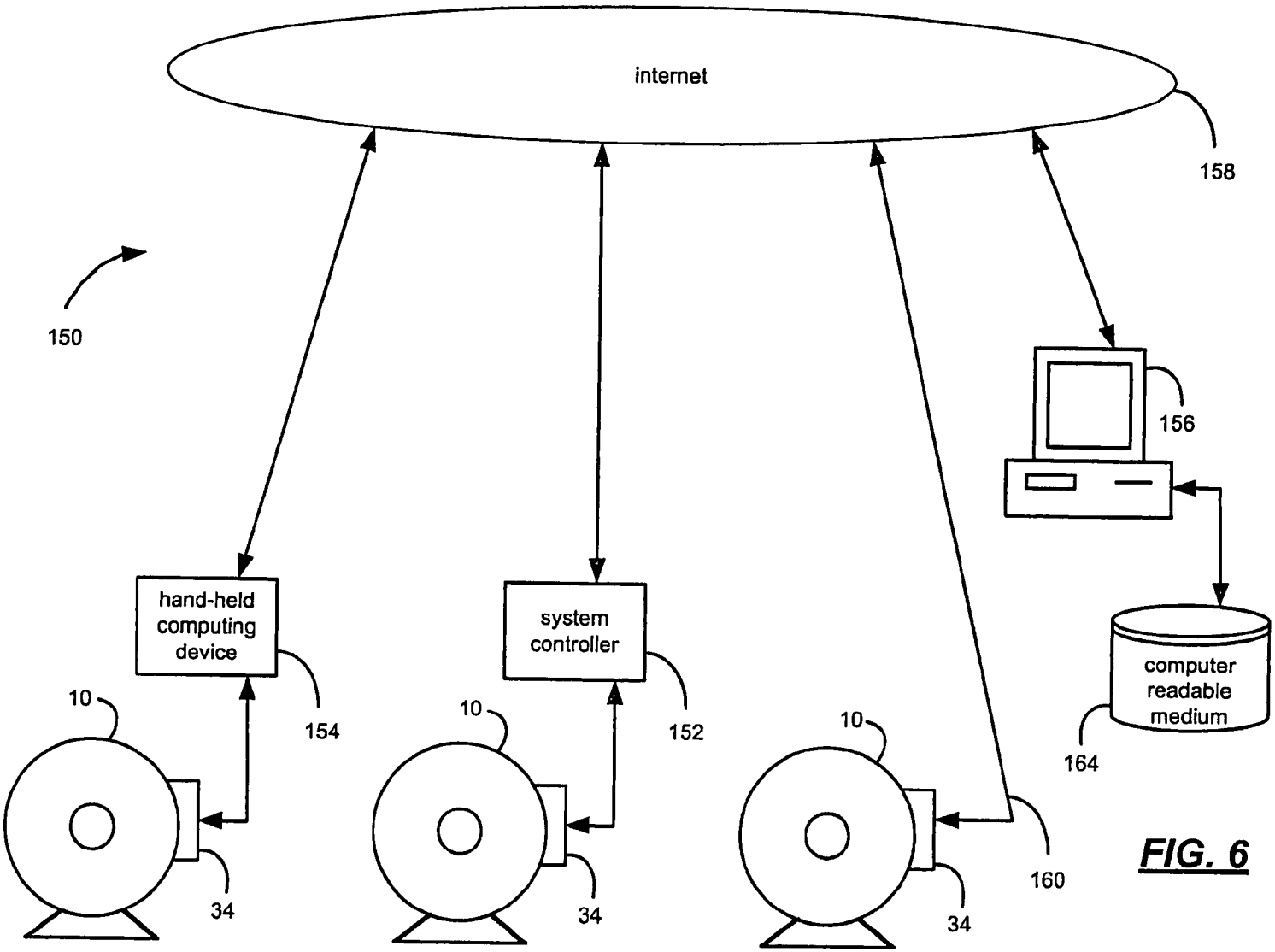
FIG. 6 is a schematic representation of a compressor information network in accordance with the present teachings.

Referring now to FIG. 6, a compressor information network 150 is shown. The protection and control system 34, or multiple protection and control systems 34, may be connected to a network. The protection and control systems 34 may be connected to the network via the communication terminal 62 which is communicatively connected to the processing circuitry 42. Alternatively, the protection and control system 34 may be connected to the network via a system controller 152, such as a refrigeration system controller. Further, the protection and control system 34 may be connected to the network via a hand-held computing device 154 or other suitable network device. The protection and control system 34 may be connected to the internet 158 via a wired or wireless internet connection 160.

The protection and control system 34 may be connected to a computer network such as the internet 158. Further, the protection and control system 34 may be connected to a database server 156 via the internet 158. The database server 156 may be a module configured to communicate with the protection and control systems 34 and with a computer information database stored in a computer readable medium 164. In this way, the contents of the memory system 45 may be accessible to other devices connected to the network, including the database server 156.

The database server 156 may collect information from the memory system 45 via a memory system information transaction initiated by the database server 156, the protection and control system 34, the system controller 152, the hand-held computing device 154, or other network device. The database server 156 may build a comprehensive compressor information database based on the contents of multiple memory systems 45 connected to the network. In this way, the database server 156 may store compressor information including compressor identity, location, operation history, service history, fault history, fault data, etc., for multiple compressors 10 connected to the network and located in multiple locations around the world.

The compressor information database may be used to evaluate compressor operation. The database may be used to improve future compressor or refrigeration system design, to improve field service technician training, and/or to determine trends related to certain similar environmental conditions. The database server information may also be used for asset management purposes as a tool to analyze sales and marketing activities. The information may also be shared with system manufacturers or system component manufacturers to assist in the design and implementation of refrigeration systems and system components. In other words, the database may provide compressor operation data, tied to geographic installation locations, compressor type and capacity, and other compressor specification data.

Figure 7:
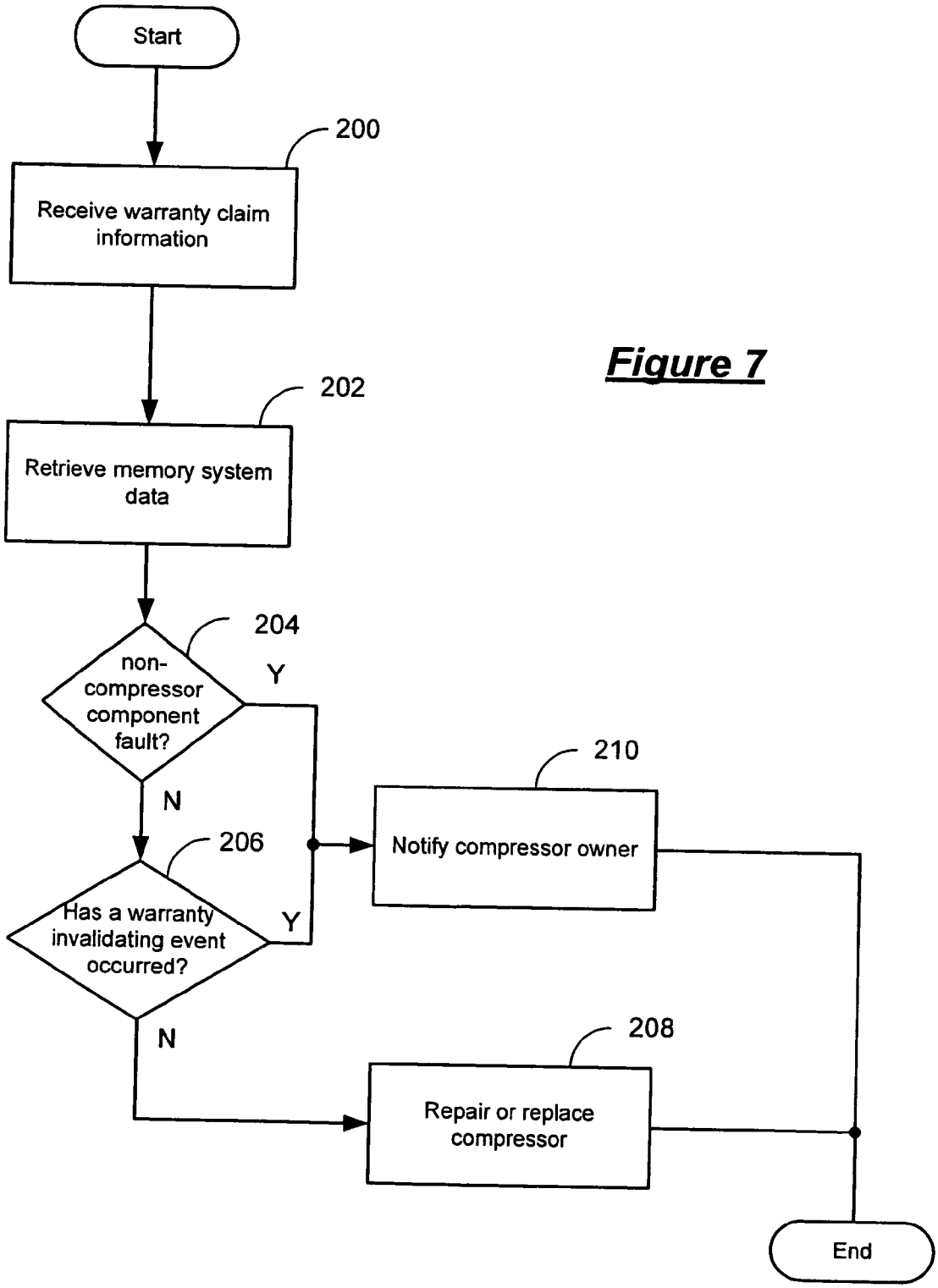
FIG. 7 is a flow chart illustrating a warranty administration method in accordance with the present teachings.

Referring now to FIG. 7, information stored in the memory system 45 may be used during the administration of compressor warranty claims. A compressor may be covered by a manufacturer's warranty. The warranty may include the terms by which the compressor may be replaced or repaired. The warranty often includes an expiration date. Further, the warranty may include terms by which compressor misuse and other warranty voiding events may be defined. The warranty voiding events may include certain misuse circumstances. For example, the warranty may include certain acceptable operating ranges, including a refrigerant level range, a refrigerant pressure range, a refrigerant temperature range, an electrical current range, an electrical voltage range, an ambient temperature range, a compressor motor temperature range, a compressor bearing temperature range, and an oil temperature data range. If the user ignores a misuse condition for a certain period of time, and allows the compressor to operate under misuse circumstances, the warranty may be voided.

When a compressor fault occurs, a claim may be made under the compressor manufacturer's warranty that the compressor 10, or a compressor component, is defective or otherwise subject to repair by the manufacturer under the terms of the warranty. In such case, the owner of the compressor may return the compressor 10 to the manufacturer with the claim indicating the reason for return. The compressor manufacturer may receive the warranty claim information in step 200.

When a compressor 10 with a memory system 45 is returned to the manufacturer under a warranty claim, the manufacturer may access the memory system 45 and examine the fault history data and operating data. The data from the memory system 45 may be retrieved by the compressor manufacturer in step 202. By examining the memory system data, the manufacturer may confirm whether the compressor 10 was the cause of the fault. When refrigeration system data is stored in the memory system 45, the manufacturer may determine that a non-compressor system component, like a condenser or evaporator, was the cause of the fault complained of in the warranty claim. In such case, the manufacturer may be able to quickly determine that the compressor 10 is not defective or in need of repair. The compressor manufacturer may determine whether a non-compressor component was at fault in step 204.

In addition, by examining the contents of the memory system 45, the manufacturer may be able to determine whether a warranty voiding event occurred prior to the compressor fault. For example, the memory system 45 may reveal that a low refrigeration fluid condition was ignored for a period of time prior to the compressor fault occurring. In such case, the manufacturer may determine that the warranty claim is void due to the compressor owner ignoring the low refrigeration fluid condition. The compressor manufacturer may determine whether a warranty invalidating event has occurred in step 206.

When the compressor 10 is at fault in step 204, and when a warranty invalidating event has not occurred in step 206, the compressor manufacturer may repair or replace the compressor under the terms of the warranty in step 208. When a non-compressor component is at fault, or when a warranty invalidating event has occurred in steps 204 or 206, the compressor manufacturer may notify the compressor owner in step 210.

When the memory system 45 is remotely accessible to the manufacturer via a network device, as discussed above, the manufacturer may be able to make a preliminary warranty claim determination prior to the compressor 10 being sent to the manufacturer. For example, prior to disconnecting the compressor from the system for return to the manufacturer, the compressor owner may simply notify the manufacturer that it believes a problem covered by the warranty has occurred. The manufacturer may then access the compressor's memory system 45 and examine the memory system data to make a preliminary determination as to the warranty claim. When a warranty voiding event has occurred, the manufacturer may inquire with the compressor owner as to the occurrence of the warranty voiding event. The compressor manufacturer may also be able to make a preliminary determination as to whether the problem complained of originated with a non-compressor component fault. Such a preliminary determination will save time and money previously lost due to unnecessary or uncovered warranty claims.

During a warranty claim, if it is determined that the compressor failure was due to failure of a non-compressor system component based on the data contained in the memory system 45, this data can be shared with the manufacturer of the non-compressor system component. In this way, data and information may be shared with other component and system manufacturers to assist in the administration of their warranty claims as well.

The description is merely exemplary in nature and, thus, variations are intended to be within the scope of the teachings. Such variations are not to be regarded as a departure from the spirit and scope of the teachings.

What is claimed is:

1. A method comprising:

delivering electric power to a motor of a compressor with at least one power lead that extends from an exterior side of a connector block attached to a shell of said compressor, through said connector block, to an interior side of said connector block to provide an electrical connection between an interior of said compressor on said interior side of said connector block and an exterior of said compressor on said exterior side of said connector block, said connector block maintaining a hermetic seal of said compressor while said electric power is delivered to said motor within said interior of said compressor;

controlling and monitoring operation of said compressor with a controller including a processor, said controller being attached to said connector block;

using said processor to access a non-volatile memory embedded within said connector block;

storing compressor data in said non-volatile memory.

2. The method of claim 1 wherein said using said processor to access said non-volatile memory includes accessing said second non-volatile memory using an RFID device.

3. The method of claim 1 wherein said storing said compressor data includes storing at least one of:

compressor model type data;

compressor serial number data;

compressor capacity data;

compressor operating coefficient data comprising numerical constants associated with said compressor and used to calculate compressor operating data.

4. The method of claim 1 wherein said storing said compressor data includes storing compressor operating coefficient data comprising numerical constants associated with said compressor, said method further comprising calculating compressor operating data based on said compressor numerical constants.

5. The method of claim 1 wherein said storing said compressor data includes storing at least one of:

compressor bill of materials data;

compressor build sheet data;

compressor build date data;

compressor build plant data;

compressor build shift data;

compressor build assembly line data;

compressor inspector data.

6. The method of claim 1 wherein said storing said compressor data includes storing at least one of:

compressor energy efficiency ratio data;

compressor low voltage start data;

compressor wattage data;

maximum compressor electrical current data;

compressor refrigerant flow data.

7. The method of claim 1 wherein said storing said compressor data includes storing at least one of:

compressor installation location data;

compressor installation date data;

compressor installer data;

compressor purchase location data.

8. The method of claim 1 wherein said storing said compressor data includes storing at least one of:

compressor repair date data;

compressor repair type data;

compressor repaired parts data;

compressor service technician data.

9. The method of claim 1 wherein said storing said compressor data includes storing at least one of:

suction pressure data;

discharge pressure data;

suction temperature data;

discharge temperature data;

electrical current data;

electrical voltage data;

ambient temperature data;

compressor motor temperature data;

compression element temperature data;

compressor bearing temperature data;

oil temperature data;

compressor control data.

10. The method of claim 1 further comprising storing refrigeration system data in said non-volatile memory, including at least one of:

condenser temperature data;

evaporator temperature data.

11. The method of claim 1 wherein said storing said compressor data includes storing compressor fault history data.

12. A method comprising:

powering a motor within a compressor with at least one power lead that extends through a connector block that hermetically seals said compressor, said connector block having a first memory embedded therein;

controlling said compressor motor with a controller that includes a processor and a second memory, said processor communicating with said first memory when said controller is attached to said connector block;

storing compressor data in said first memory when said controller is detached from said connector block.

13. The method of claim 12 wherein said communicating includes accessing said first memory with an RFID device.

14. The method of claim 12 wherein said storing said compressor data includes storing at least one of:

compressor model type data;

compressor serial number data;

compressor capacity data;

compressor operating coefficient data comprising numerical constants associated with said compressor and used to calculate compressor operating data.

15. The method of claim 12 wherein said storing said compressor data includes storing compressor operating coefficient data comprising numerical constants associated with said compressor, said method further comprising calculating compressor operating data based on said compressor numerical constants.

16. The method of claim 12 wherein said storing said compressor data includes storing at least one of:

compressor bill of materials data;

compressor build sheet data;

compressor build date data;

compressor build plant data;

compressor build shift data;

compressor build assembly line data;

compressor inspector data.

17. The method of claim 12 wherein said storing said compressor data includes storing at least one of:

compressor energy efficiency ratio data;

compressor low voltage start data;

compressor wattage data;
maximum compressor electrical current data;
compressor refrigerant flow data.

18. The method of claim 12 wherein said storing said compressor data includes storing at least one of:
compressor installation location data;
compressor installation date data;
compressor installer data;
compressor purchase location data.

19. The method of claim 12 wherein said storing said compressor data includes storing at least one of:
compressor repair date data;
compressor repair type data;
compressor repaired parts data;
compressor service technician data.

20. The method of claim 12 wherein said storing said compressor data includes storing at least one of:
suction pressure data;
discharge pressure data;
suction temperature data;
discharge temperature data;
electrical current data;
electrical voltage data;
ambient temperature data;
compressor motor temperature data;
compression element temperature data;
compressor bearing temperature data;
oil temperature data;
compressor control data.

21. The method of claim 12 further comprising storing refrigeration system data in said first memory, wherein said storing refrigeration system data includes storing at least one of:
condenser temperature data;
evaporator temperature data.

22. The method of claim 12 wherein said storing said compressor data includes storing compressor fault history data.

23. The method of claim 12 further comprising:
retrieving said compressor data from said first memory and storing said compressor data remotely from said compressor.

24. The method of claim 12 further comprising:
evaluating said compressor data to determine compressor performance;
generating output based on said evaluating.

25. The method of claim 12 wherein first memory is molded in said connector block.

26. The method of claim 12 further comprising monitoring operation of said compressor with said controller.

27. The method of claim 12 wherein said first memory comprises a non-volatile memory.

28. The method of claim 12 further comprising writing said compressor data to said first memory during operation of said compressor.

29. The method of claim 12 further comprising writing said compressor data to said first memory before installation of said compressor in a refrigeration system.

* * * * *